US008280086B2

(12) United States Patent
Topholm

(10) Patent No.: US 8,280,086 B2
(45) Date of Patent: Oct. 2, 2012

(54) REMOTE CONTROL SYSTEM FOR A HEARING AID

(75) Inventor: Julian Topholm, Lyngby (DK)

(73) Assignee: Widex A/S, Lynge (DK)

( * ) Notice: Subject to any disclaimer, the term of this patent is extended or adjusted under 35 U.S.C. 154(b) by 1205 days.

(21) Appl. No.: 11/856,686

(22) Filed: Sep. 17, 2007

(65) Prior Publication Data

US 2008/0049957 A1 Feb. 28, 2008

Related U.S. Application Data

(63) Continuation-in-part of application No. PCT/DK2005/000188, filed on Mar. 18, 2005.

(51) Int. Cl.
*H04R 25/00* (2006.01)
*H04R 29/00* (2006.01)

(52) U.S. Cl. ..... 381/315; 381/60; 381/312

(58) Field of Classification Search ..... 381/312, 381/314, 315; 455/575.1, 575.2, 556.1; 379/52
See application file for complete search history.

(56) References Cited

U.S. PATENT DOCUMENTS 6,021,207 A * 2/2000 Puthuff et al. ..... 381/330
2004/0165731 A1 8/2004 Ribic
2004/0234090 A1* 11/2004 Berg ..... 381/314
2005/0008175 A1 1/2005 Hagen
2007/0009123 A1* 1/2007 Aschoff et al. ..... 381/315

FOREIGN PATENT DOCUMENTS

| | | | |
|---|---|---|---|
| EP | 1 250 026 | A1 | 10/2002 |
| EP | 1382220 | B1 | 6/2005 |
| JP | 2002027029 | | 1/2002 |
| JP | 2004064457 | | 2/2004 |
| JP | 2004527183 | | 9/2004 |
| WO | WO 98/44762 | A1 | 10/1998 |
| WO | 0154458 | A2 | 7/2001 |
| WO | WO 01/54458 | A2 | 7/2001 |
| WO | 02089520 | A2 | 11/2002 |
| WO | WO 2004/098238 | A2 | 11/2004 |

OTHER PUBLICATIONS

Japanese Office Action 2008-501159 Sep. 9, 2008 with translation.

* cited by examiner

*Primary Examiner* — Curtis Kuntz
*Assistant Examiner* — Sunita Joshi
(74) *Attorney, Agent, or Firm* — Sughrue Mion, PLLC

(57) ABSTRACT

A remote control system for a hearing aid (9) comprises a mobile telephone (1) and a plug-in device (5). The mobile telephone (1) is executing hearing aid remote control software and transmitting commands to the hearing aid (9) via the plug-in device (5). The plug-in device (5) comprises means for transmitting remote control commands or audio to the hearing aid (9) wirelessly. The invention provides a system, a plug-in device and a mobile telephone.

15 Claims, 3 Drawing Sheets

REMOTE CONTROL SYSTEM FOR A HEARING AID

RELATED APPLICATIONS

The present application is a continuation-in-art of application No. PCT/DK2005/000188 filed on 18 Mar. 2005 in Demark.

BACKGROUND OF THE INVENTION

1. Field of the Invention

This invention relates to hearing aids. More specific, it relates to programmable hearing aids with wireless remote control capabilities and to devices for wireless remote control of hearing aids.

Modern, programmable hearing aids are adapted for being programmed by a fitter using a personal computer equipped with a dedicated interface. The interface may be wired or wireless, and the hearing aids may be programmed using dedicated software running on the personal computer.

2. The Prior Art

Wireless remote controls for user control of hearing aids are also known. They are usually dedicated, hand-held devices for controlling simple functions, e.g. regulating the output volume from the hearing aids or changing among different programs stored in the hearing aids. Upgrading the remote controls with new functionality may be difficult or impossible because of this dedication, and a remote control device may also easily get lost or mislaid.

U.S. Pat. No. 4,947,432 provides a programmable hearing aid with an amplifier and transmission section whose transmission characteristics can be controlled, with a control unit, with a transmitter for wireless transmission of control signals to the hearing aid and a receiver located therein for receiving and demodulating control signals, whereby the external control unit has a keypad and a transmitter.

U.S. Pat. No. 5,202,927 provides a remote-controllable, programmable hearing aid system, including a hearing aid and an external control unit with a transmitter for wireless transmission of control parameters to the hearing aid. A receiving circuit for receiving the control parameters is located in the hearing aid.

WO 00/22874 discloses a fitting system for a hearing device, where the input device is a mobile telephone. Means for communication between the mobile telephone and the hearing device may be embodied as a separate unit or may be built into the mobile telephone. Fitting of the hearing aid may then be carried out through the use of an application running on the mobile telephone and operated either by the keyboard of the mobile telephone or by voice commands spoken into the microphone of the mobile telephone.

SUMMARY OF THE INVENTION

The invention, in a first aspect, provides a remote control system for a hearing aid, said hearing aid being provided with a microphone, a first wireless receiver, a first wireless transmitter, and means for streaming audio via the first wireless transmitter, said remote control system comprising a plug-in device and a mobile telephone, said plug-in device being provided with a second wireless transmitter and a second wireless receiver for communicating bidirectionally with the hearing aid and means for connecting with a mobile telephone, and said mobile telephone being provided with a memory for storing an audio stream received from the hearing aid via the plug-in device.

This enables a mobile telephone to double as a user interface of a wireless remote control of a hearing aid.

Within the context of this application, a mobile telephone is defined as a hand-held unit having a microphone, a loudspeaker, a battery, a processor and a wireless communications unit adapted for communicating according to a GSM communications protocol, a 3G communications protocol or a similar standard wireless interface protocol.

The invention, in a second aspect, provides a plug-in device for use in a remote control system for hearing aids, comprising means for communicating wirelessly with a hearing aid, means for connecting with a mobile telephone, and means for interpreting commands from the mobile telephone in order to transmit remote control commands to the hearing aid.

An existing mobile telephone having capabilities for connecting external devices such as cameras, MP3-players, Bluetooth®-devices and other peripheral equipment, may be readily used to connect with such a plug-in device.

The plug-in device comprises an electric plug for connecting to the mobile telephone. The plug-in device may be powered by the power source of the mobile telephone when connected, and data signals and audio signals may then be transferred between the mobile telephone and the plug-in device. Pins for power, data, and audio signals may be readily available in the mobile telephone for the plug-in device to use.

The invention, in a third aspect, provides a mobile telephone for use in a remote control system for hearing aids, comprising means for displaying a remote control user interface for a hearing aid, means for communicating with a plug-in device adapted for transmitting commands and audio to the hearing aid, means for remote controlling the hearing aid using the remote control user interface, means for transmitting audio to the hearing aid via the plug-in device, and a memory for storing an audio stream.

This enables the mobile telephone to be used as a remote control for a hearing aid without the need for separate display and input means, relying on means readily available in the mobile telephone.

Further details and advantages of the remote control system according to the invention are described in the dependent claims.

BRIEF DESCRIPTION OF THE DRAWINGS

The invention will now be described in more detail with respect to the drawings, where.

DETAILED DESCRIPTION OF THE INVENTION

Figure 1:
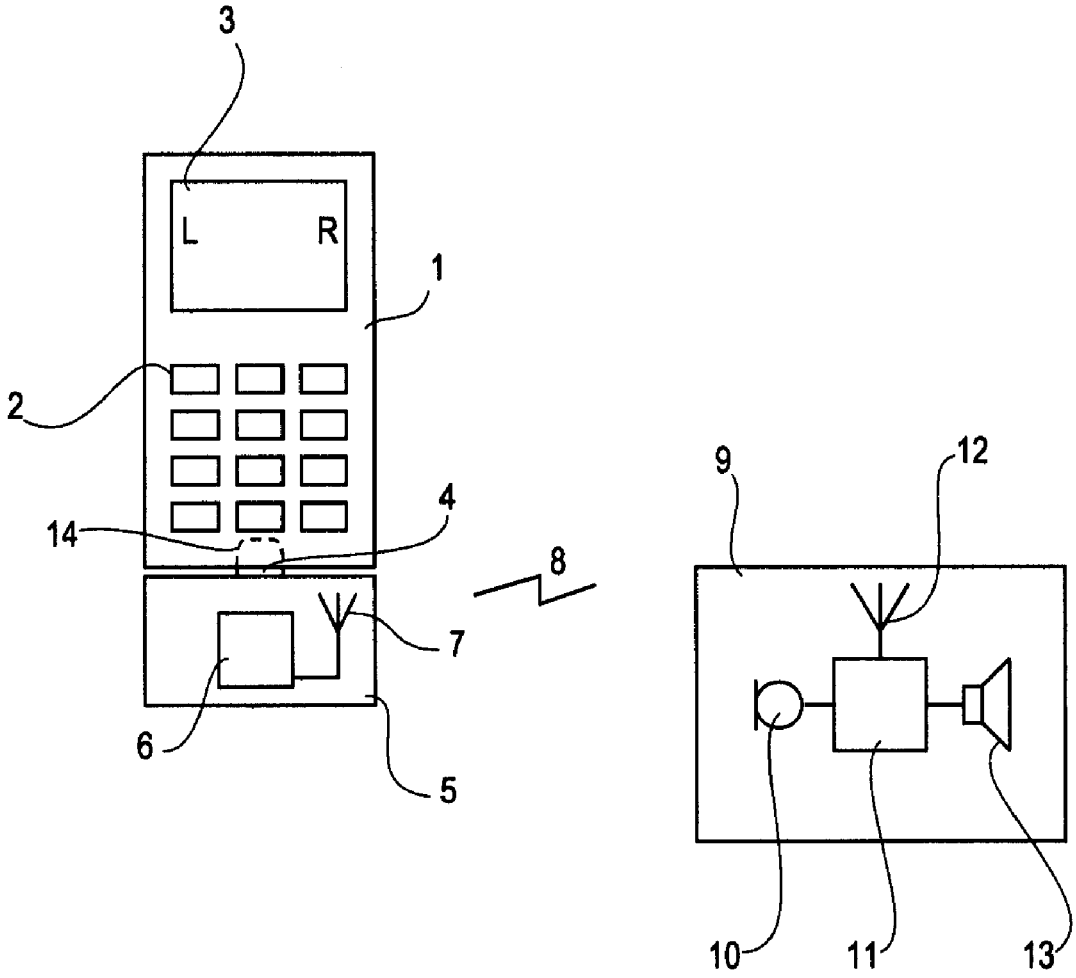
FIG. 1 shows a remote control system according to the invention.

Reference is first made to FIG. 1, which shows a plug-in device 5 connected to a mobile telephone 1 through a plug 4 and a socket 14 for the purpose of remotely controlling a hearing aid 9. The mobile telephone 1 may be operated by a keypad 2 and a display 3, and may comprise remote control software (not shown) or access software (not shown) embedded in the plug-in device 5 and accessed via the plug 4 and socket connection 14.

The plug-in device 5 comprises a wireless transmitter or transceiver 6 and an antenna 7 for communicating with the hearing aid 9. The hearing aid 9 comprises an acoustic input transducer 10, a hearing aid processor 11, an antenna 12 and an acoustic output transducer 13. The hearing aid processor 11 comprises a wireless receiver or transceiver (not shown) for the purpose of receiving messages 8 from the transmitter 6 in the plug-in device 5 and for transmitting signals to the transceiver 6 in the plug-in device 5.

When plugged into the mobile telephone 1, the plug-in device 5 makes its embedded software available to the mobile telephone 1. The software comprises remote control routines for controlling transmission or receipt of remote control signals to or from the hearing aid 9 via the wireless transceiver 6 and the antenna 7 in the plug-in device 5. The embedded software is executed by the hardware platform of the mobile telephone 1, thereby transforming the mobile telephone 1 into a remote control for the hearing aid 9.

The remote control software may, in an alternate embodiment, be resident in the mobile telephone itself to be activated on demand by connecting the plug-in device 5.

Figure 2:
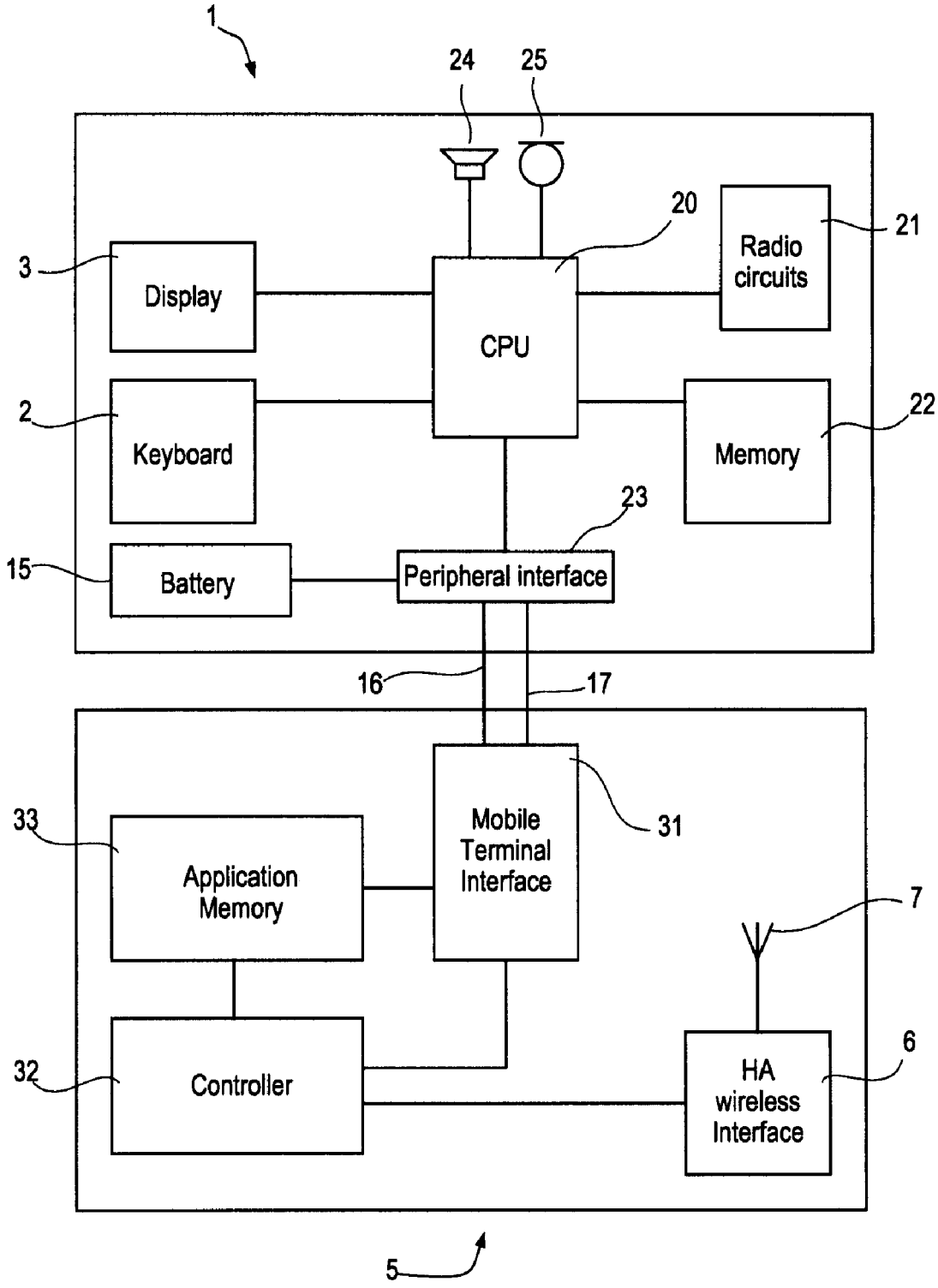
FIG. 2 is a block schematic showing a mobile telephone and a plug-in device.

FIG. 2 shows a more detailed view of a mobile telephone 1 with the plug-in device 5 of the invention. The mobile telephone 1 comprises a CPU 20 connected to a keypad 2, a display 3, radio circuits 21 for mobile telephone communications, a memory 22, and a peripheral interface 23 having means for connecting various peripheral devices to the mobile telephone 1. The plug-in device 5 comprises a controller 32 connected to a mobile telephone interface 31 and a radio interface 6 comprising an antenna 7 for communicating with a hearing aid (not shown). The mobile telephone interface 31 is connected to an application memory 33 and is associated with the plug 4 for connecting the plug-in device 5 to a suitable socket 14 in a mobile telephone (ref FIG. 1). The plug and the socket are adapted to provide electrical connections between the plug-in device 5 and the mobile telephone 1 for purposes such as digital communication, analog communication, power supply, etc.

The mobile telephone 1 in FIG. 2, when not connected to the plug-in device 5, is adapted to operate to perform functions not specifically related to a hearing aid. User input is entered using the keypad 2, feedback is presented by the display 3, communication is taken care of through the radio interface 21, data are stored in the memory 22, and everything is controlled by the CPU 20 executing applications stored in the memory 22.

The moment a plug-in device 5 is connected to the mobile telephone 1, the peripheral interface 23 sends a message to the CPU 20 that an external unit is ready and offering its services. The CPU 20 responds by sending a request for available applications in the application memory 33 of the plug-in device 5 via the peripheral interface 23 of the mobile telephone 1 and the mobile telephone interface 31. The plug-in device 5 responds to the request by making its application software, stored in the application memory 33, available for execution by the CPU of the mobile telephone 1. The application software provides the functionality of a remote control for a hearing aid to the mobile telephone 1, e.g. displaying a remote control menu and enabling remote control input by the keys of the telephone keypad.

While the plug-in device is plugged in, the keypad 2 and the display 3 of the mobile telephone 1 are used to remotely operate a hearing aid (ref. FIG. 1). The display 3 provides user feed-back such as read-outs about volume settings, program changes, battery condition and various other parameters in the hearing aid, and the keypad 2 is used to enter user commands such as requests for program changes and volume adjustments in the hearing aid, the changes being reflected in the display 3 and in the behavior of the hearing aid.

Commands entered via the keypad 2 in the mobile telephone 1 are processed by the CPU 20 running the software application (not shown) from the application memory 33 of the plug-in device 5. The processed commands enter the controller 32 of the plug-in device via the peripheral interface 23 of the mobile telephone 1 and the mobile telephone interface 31 of the plug-in device 5. The controller 32 of the plug-in device 5 then utilizes the wireless remote control interface 6 with the antenna 7 to transmit the commands to the hearing aid (not shown). The hearing aid responds to the commands by transmitting e.g. an acknowledge signal, which is received by the antenna 7 of the plug-in device 5, and the controller 32 transmits the acknowledge signal back to the mobile telephone 1 via the mobile telephone 31 and the peripheral interface 23 for decoding by the CPU 20 and displaying on the display 3.

The application software may also include a so-called "streaming" mode of operation of the plug-in device 5 and the mobile telephone 1. In this mode, incoming telephone calls received by the radio circuits of the mobile telephone 1 are transmitted as a digital audio stream to the plug-in device 5, which conditions the digital audio stream into a format that can be received by a hearing aid (not shown) and transmits the conditioned audio stream using the wireless interface 6 and the antenna 7. Likewise, audio picked up by the microphone of a hearing aid (not shown) may be transmitted as a digital audio stream from the hearing aid to the wireless interface 6 of the plug-in device 5 and made available to the mobile telephone 1.

In a modified embodiment, the plug-in device and the mobile telephone are adapted for the exchange of audio information by analog signals.

Digital audio stored in the memory 22 of the mobile telephone may also be transmitted to the hearing aid (not shown) via the plug-in device 5. Other applications may include, but is not in any way limited to, using the mobile telephone 1 as a dictating device recording and storing an audio stream from a hearing aid in the memory 22 of the mobile telephone 1 using the hearing aid microphone as an input device.

In one embodiment, the plug-in device has a receiver for infrared (IR) signals and means for converting IR-inputs into audio signals for transmission to the hearing aid.

Figure 3:
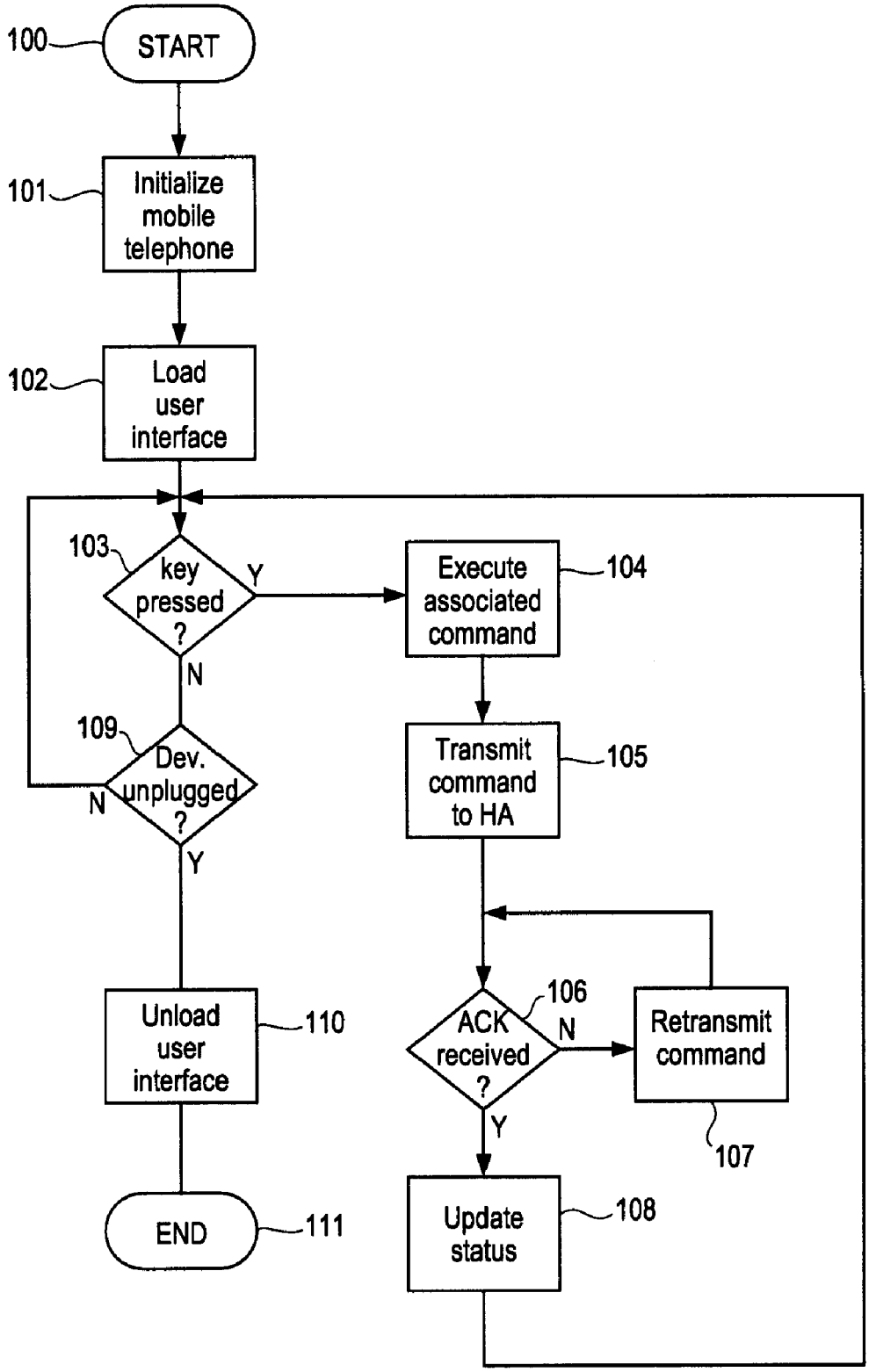
FIG. 3 is a flowchart illustrating the communication flow between the mobile telephone and the plug-in device.

The flowchart in FIG. 3 is an algorithm showing the basic flow of communication between a mobile telephone 1 and a plug-in device 5 as shown in FIGS. 1 and 2. The algorithm starts in step 100 when the plug-in device 5 is connected to a mobile telephone 1. In the following discussion, the plug-in device 5 is assumed to obtain its power from the power source of the mobile telephone 1. The actual execution of the algorithm is further assumed to be performed by the CPU 20 of the mobile telephone 1 in FIG. 2. The operating system software environment of the mobile telephone 1 is assumed to be a preemptive multitasking software environment capable of running several different applications concurrently in such a way that one running process is incapable of locking the system by taking up system resources from other processes.

When the device 5 is plugged into the mobile telephone 1, the application is loaded from the application memory 33 to the mobile telephone memory 22. Once booted up in step 100, the software algorithm in FIG. 3 continues in step 101 with a procedure initializing the mobile telephone 1 the plug-in device 5 is about to communicate with. This procedure may include handshaking signals, protocol negotiations, retrieving the version number of the operating system present in the mobile telephone 1, identification codes, and the type and number of facilities available in the mobile telephone 5.

When a common interface configuration is established in the way described in the foregoing, the algorithm continues in step 102 by loading the appropriate user interface into the application running on the mobile telephone 1. The actual loading of the interface is determined by the make and facilities of the hearing aid to be controlled by the application, user-selectable facilities chosen, and the make and model of mobile telephone used as determined by the initialization procedure in step 101.

The algorithm now enters a loop, where a test for a key press in the mobile telephone 1 is performed in step 103. If no key is pressed, the routine checks in step 109 if the device has been unplugged. If this is not the case, the routine repeats step 103 indefinitely. When a key is pressed, the routine determines the associated command and executes it in step 104. Keys not allocated to the particular functionality of the application are simply ignored. The command associated to the particular key press is prepared by the controller 32 of the plug-in device 5 and transmitted to the hearing aid using the wireless interface 6 and the antenna 7.

The routine then waits for an acknowledgement message to be received from a hearing aid. If such a transmission is not received within the expiration of a predetermined period as tested in step 106, the command is retransmitted by the routine in step 107. If the acknowledgement is not received after several attempts, the routine may take steps (not shown) to deal with this situation, such as generating an error message, waiting for a longer time, or simply indicating to the user that the command was not received successfully. If an acknowledgement message is received successfully, the altered status of the hearing aid is reflected in the application and indicated in the display in step 108, and the routine returns to wait for another key press in step 103.

If the device is unplugged, as tested for in step 109, the user interface and application parameters are unloaded from the mobile telephone 1 in step 110. The application then unloads itself from the memory 22 in the ending step 111, and the mobile telephone resumes its state from before plugging in the plug-in module 5.

I claim:

1. A plug-in device for a mobile telephone, comprising:

an electric plug for connecting to the mobile telephone, for providing an electric path for transferring an audio signal between the mobile telephone and the plug-in device;

a wireless interface for wirelessly communication with at least one hearing aid, whereby said audio signal is transferred from the plug-in device to said at least one hearing aid; and a memory containing application software for execution by the mobile telephone when the plug-in device is connected to the mobile telephone.

2. Plug-in device according to claim 1, wherein the electric plug provides a power supply for the plug-in device, whereby the plug-in device is powered by the power source of the mobile telephone when connected.

3. Plug-in device according to claim 1, wherein the electric plug provides an electric path for exchanging data signals between the plug-in device and the mobile telephone.

4. Plug-in device according to claim 1, wherein the electric plug provides an electric path for exchanging audio signals between the plug-in device and the mobile telephone.

5. Plug-in device according to claim 1, wherein the application software when executed by the mobile telephone provides a streaming mode of operation in which the audio signal of an incoming telephone call is transferred via the plug-in device to the hearing aid.

6. Plug-in device according to claim 5, wherein audio picked up by the microphone of a hearing aid is transferred via the plug-in device to the mobile telephone.

7. A remote control system for hearing aids, comprising:

a mobile telephone having a processor, a keypad and a connector socket;

a plug-in device for the mobile telephone, said plug-in device comprising:

an electric plug for connecting to the mobile telephone, for providing an electric path for transferring an audio signal between the mobile telephone and the plug-in device;

a wireless interface for wirelessly communication with at least one hearing aid, whereby said audio signal is transferred from the plug-in device to said at least one hearing aid; and a memory containing application software for execution by the mobile telephone when the plug-in device is connected to the mobile telephone.

8. Remote control system according to claim 7, wherein the application software, contained in the memory upon execution in the mobile phone, provides a remote control menu on a mobile telephone and enables remote control input by keys of the telephone keypad.

9. Remote control system according to claim 8 wherein the mobile telephone is enabled to perform remote control commands for volume adjustment in the hearing aid.

10. Remote control system according to claim 8 wherein the mobile telephone is enabled to perform remote control commands for program selection in the hearing aid.

11. Remote control system according to claim 7, wherein the application software, contained in the memory upon execution in the mobile phone, provides a streaming mode of operation of the plug-in device, the hearing aid and the mobile telephone, and in this mode, the audio signal of incoming telephone calls is transferred from the phone via the plug-in device to the hearing aid.

12. A computer program product carrying a computer program embodied in a memory in the plug-in device according to claim 7 and, upon execution in the mobile phone, is adapted to offer a remote control menu on a mobile telephone and to enable remote control input by keys of the telephone keypad.

13. A computer program product according to claim 12 wherein the mobile telephone is enabled to perform remote control commands for volume adjustment in the hearing aid.

14. A computer program product according to claim 12 wherein the mobile telephone is enabled to perform remote control commands for program selection in the hearing aid.

15. A computer program product carrying a computer program embodied in a memory in the plug-in device according to claim 1 and, upon execution in the mobile phone, performing a streaming mode of operation of the plug-in device, the hearing aid and the mobile telephone, and in this mode, the audio signal of incoming telephone calls is transferred from the phone via the plug-in device to the hearing aid.

* * * * *